United States Patent [19]

Johnson

[11] 4,359,176

[45] Nov. 16, 1982

[54] POWERED HOPPER DOOR

[76] Inventor: Grady L. Johnson, Rte. 1, Box 378, Luxora, Ark. 72358

[21] Appl. No.: 188,444

[22] Filed: Sep. 19, 1980

[51] Int. Cl.[3] ..... B61D 7/20; B61D 7/28

[52] U.S. Cl. ..... 222/504; 222/310; 222/505; 222/561; 105/282 R

[58] Field of Search ..... 105/282 R, 282 B, 240, 105/282; 298/24, 27, 28; 222/504, 505, 559, 561, 512, 310

[56] References Cited

U.S. PATENT DOCUMENTS

| | | | |
|---|---|---|---|
| 1,360,805 | 11/1920 | Sherman et al. . | |
| 1,384,175 | 7/1921 | Allen et al. . | |
| 2,227,712 | 1/1941 | Hackley | 105/282 A |
| 2,303,033 | 11/1942 | Elliott . | |
| 3,066,831 | 12/1962 | Thompson | 222/512 |
| 3,252,630 | 5/1966 | Berg | 222/504 |
| 3,397,654 | 8/1968 | Snyder | 222/561 |
| 3,931,934 | 1/1976 | Smith | 222/504 |
| 4,004,700 | 1/1977 | Empey . | |
| 4,051,785 | 10/1977 | Bessette . | |
| 4,248,158 | 2/1981 | Chierici et al. | 222/512 |

*Primary Examiner*—Joseph J. Rolla
*Assistant Examiner*—Frederick R. Handren
*Attorney, Agent, or Firm*—Dowell & Dowell

[57] ABSTRACT

A power actuated closure assembly for controlling the discharge of materials from an opening in the bottom of a hopper, the assembly including a frame having a sliding door support portion with a power actuator support portion extending longitudinally therefrom and supporting a cylinder whose piston rod is coupled to the door by a longitudinal bar which is guided by a fixed guide, the piston rod being connected with the door moving bar by a lost-motion coupling, the guide through which the bar passes having a latch for locking the door and bar in one of several selected positions and the guide also having a longitudinal slot capable of receiving a pin carried by the bar, the pin and slot limiting the movement of the door to a small increment suitable for spreading material over a large area such as a roadway.

9 Claims, 5 Drawing Figures

POWERED HOPPER DOOR

BACKGROUND AND PRIOR ART

Bulk material handling vehicles, such as railway cars or trucks are generally provided with a discharge hopper having a selectively operable discharge door for controlling flow of the bulk materials through an opening at the bottom of the hopper. Such discharge doors are sometimes manually operated, but are frequently controlled by a power device such as an hydraulic cylinder. The doors often slide in guiding channels, and these channels tend to become clogged with the bulk materials so that it can be difficult to start a door opening, or move it through a small increment in either direction, especially when the bulk materials above the door are applying high gravitational pressures on it. The doors are sometimes mounted on rollers so as to make them easier to move, for example as shown in Sherman et al. 1,360,805, or Empey U.S. Pat. No. 4,004,700, such doors then being reciprocated back and forth across the opening by the piston rod of an hydraulic cylinder which is coupled by suitable coupling means to the door. The piston is often mounted offset longitudinally or transversely of the hopper so that it is not directly beneath its opening, some doors using a linkage mechanism as shown in Elliott U.S. Pat. No. 2,303,033 whose door is also supported on rollers.

It is also frequent practice to mount a rack along each longitudinal edge of the door and engage the rack with spaced pinions which are fixed to a common shaft so as to prevent the door from cocking and binding in the longitudinal channels which support it, such structures being shown in Allen et al. U.S. Pat. No. 1,384,175 and in Bessette U.S. Pat. No. 4,051,785.

Nevertheless, despite the use of power cylinders and antifriction supporting means, the doors do tend to stick, and are especially difficult to move through small increments, as may be required when the hopper is being used to discharge a bulk material at a measured rate, for instance when spreading particulates on a highway. A distinction must be drawn between on the one hand opening of a door for the purpose of completely discharging the hopper at a high discharge rate, as might be desirable when emptying the hopper into some other container, and on the other hand the concept of discharging the hopper contents at a very slow and carefully measured rate as would be required during spreading of the material over a large area where uniformity of discharge rate is a requirement. In the latter case, it is not only difficult to start the door moving using the hydraulic cylinder, especially when the hopper is full, but it is also difficult to move the door through a small closely predetermined increment as is required when spreading materials over a large area. The present invention seeks to provide improvements in these modes of operation, without unnecessarily increasing the cost of the device.

Copies of the five patents discussed above are filed with this specification in lieu of a prior art statement.

THE INVENTION

The invention comprises a power actuated door closure assembly for controlling the discharge of materials through an opening in the bottom of a hopper, the assembly including a frame having a door support portion extending around the opening in the hopper and supporting the door in sliding relationship in a channel extending longitudinally of the frame, and the frame having a second portion for supporting the power actuator which operates the door, the door comprising a plate which is fixed to the longitudinally reciprocating piston rod member of the actuator by a longitudinal bar which couples the door to the piston rod member, the bar extending through a guide means which is supported on the frame, the guide means having a manually operable latch which can be extended through the guide and the bar to lock the door in a selected position. The guide also has a longitudinal slot in its side wall which, when a hole in the bar is registered with the slot, receives a pin which can then reciprocate in the slot to provide a limited longitudinal motion of the door, for example to permit it to open only slightly when used for distributing material from the hopper, for instance along a highway. The piston rod of the actuator is coupled with the bar which operates the door through a lost motion coupling which permits the piston rod to move through a short distance before becoming engaged with the bar, whereby the piston can begin moving in unloaded condition before the lost motion runs out and the piston impacts against the door-moving bar, thereby jarring the door into motion in the desired direction. The door is provided with spaced racks extending longitudinally along its lower surface, the racks having teeth which engage a pair of pinions which are fixed to a common shaft extending across the frame, the rack and pinion arrangement preventing cocking and binding of the door in the channels which guide it along the frame.

OBJECTS AND ADVANTAGES OF THE INVENTION

It is a principle object of the invention to provide a power actuated closure assembly of the type specified having an impact feature comprising a lost motion coupling located between the actuating cylinder means and the door and permitting the piston rod of the cylinder to accelerate before providing impact followed by drive to move the position of the door.

It is another object of the invention to provide a bar passing through a fixed guide and coupling the door with the actuating cylinder means, the guide having means for latching the door in any one of multiple selectible positions whereby the door will be locked in place when power is removed from the cylinder means.

Still another object of the invention is to provide a power actuated closure assembly having a bar connecting the door with the actuating cylinder means and having a guide surrounding the bar and fixed to the frame, the guide being provided with a slot in its sidewall, and the bar being provided with a hole for supporting a pin which extends into the slot and limits the movements of the door to a small increment equal to the length of the slot and suitable for discharging materials at a controlled rate from the hopper for purposes of spreading the materials uniformly over a large area, the limited movement of the door preventing accidental loss of a large quantity of the material in the event the operator should leave power on the actuator means beyond the time interval required to open the door through the required small increment.

It is a further object of the invention to provide an improved and simplified frame structure for supporting the door, the power actuator, and the bar and guide and latch structure, with the parts thereof oriented in an optimal manner.

Yet another object of the invention is to provide means for insuring that the door will slide straight in the channels which support it, whereby cocking and binding of the door is prevented, such means including rack and pinion means which are so located with respect to the hopper that particulate materials will fall away from the teeth of the rack, whereby no buildup of materials tending to bind movement of the rack can occur.

Other objects of advantages of the invention will become apparent during the following discussion of the drawings.

THE DRAWINGS

DESCRIPTION OF PREFERRED EMBODIMENT

Figures 1, 4, 5:
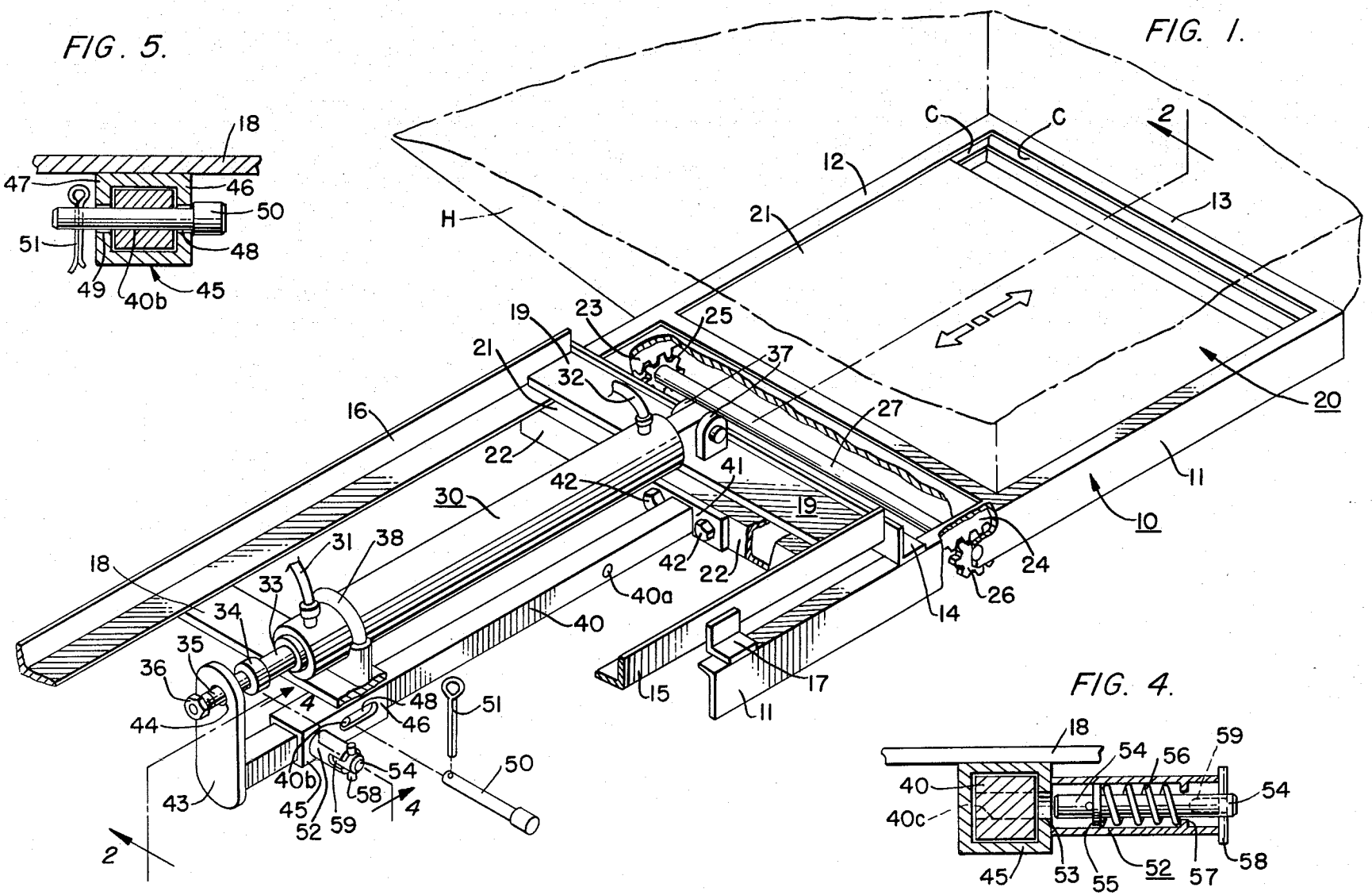
FIG. 1 is a perspective view of a power actuated closure assembly located at the opening in a hopper, the assembly being shown partly in cross-section.
FIG. 4 is a fragmentary sectional view taken along line 4—4 of FIG. 1.
FIG. 5 is a fragmentary sectional view taken along 5—5 of FIG. 2.
Figure 2:
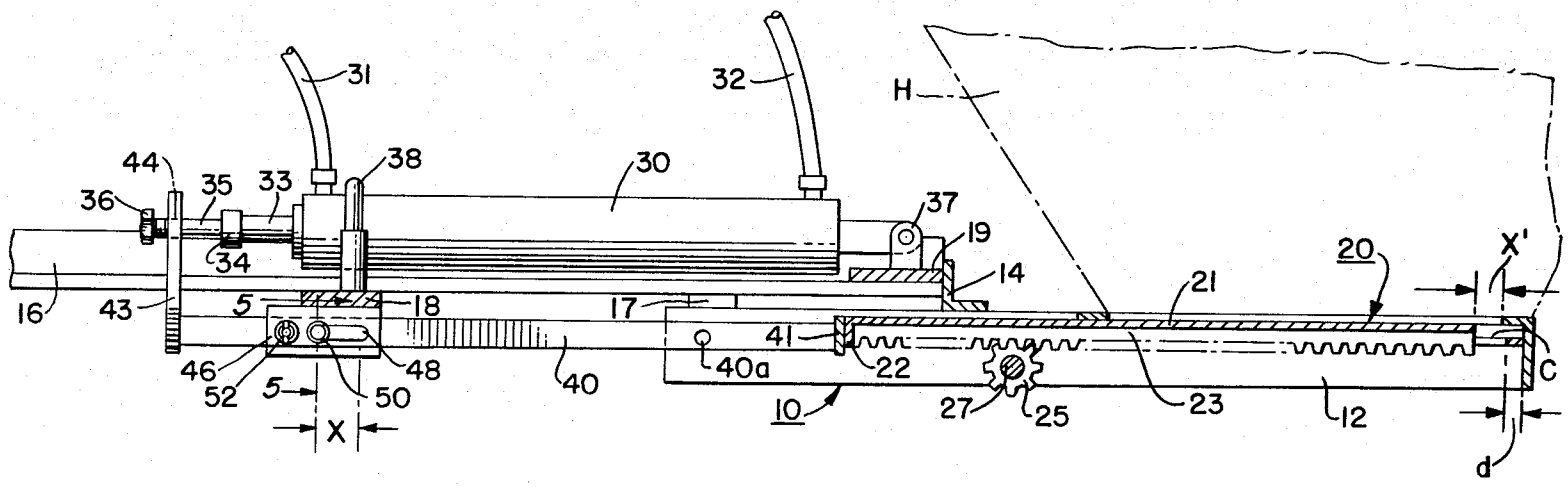
FIG. 2 is a sectional view of the closure assembly taken along line 2—2 of FIG. 1 and showing the relative positions of the parts when the door is opened through only a small increment, as is used when distributing particulate materials over a large area.
Figure 3:
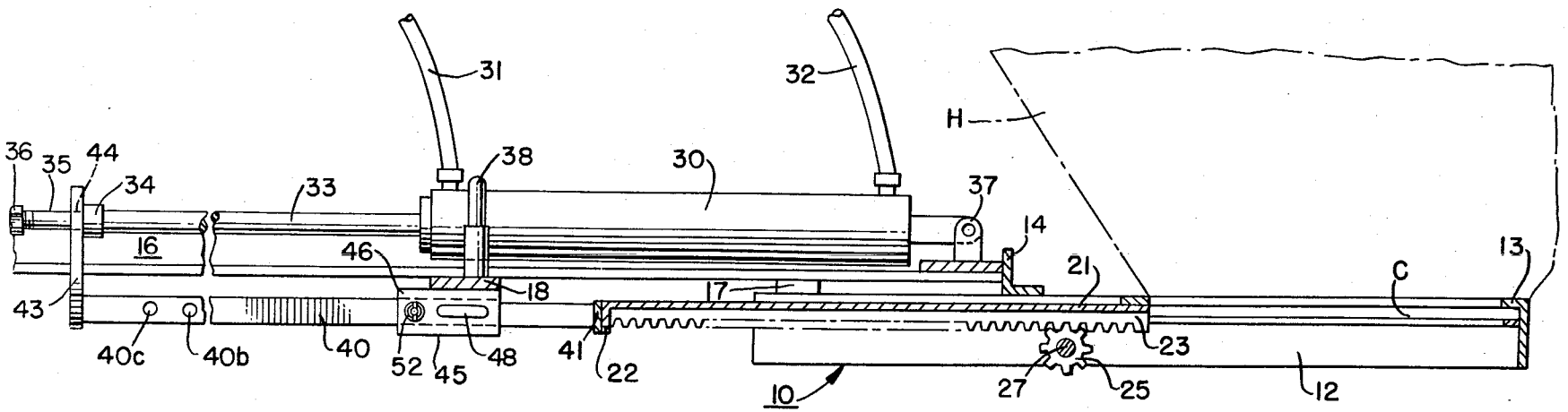
FIG. 3 is a view similar to FIG. 2 but showing the relative positions of the parts when the door is fully opened.

Referring now to the drawings, FIG. 1 shows a hopper H having a frame 10 around the opening in the bottom of the hopper, the frame having a door support portion which is located directly beneath the hopper and comprises opposed channel members such as the longitudinal channel members 11 and 12 and transverse channel member 13. Inside the channel members 11, 12 and 13 a channel C is formed which supports the door 20 so that it can slide longitudinally in the channels. The door 20 comprises a horizontal plate 21 which extends longitudinally beyond a transverse angle member 14 of the frame. The end of the plate 21 is bent downwardly as shown at 22 and this bent portion 22 connects with power actuator means as will be discussed presently. The plate 21 of the door 20 carries two spaced racks 23 and 24 as can be seen in FIGS. 1, 2 and 3, the racks 23 and 24 having downwardly facing teeth which engage with pinions 25 and 26 which are fixed to and supported on a shaft 27 whose ends are journaled in the vertical portions of the side channels 11 and 12 of the frame 10.

The side channels 11 and 12 extend longitudinally beyond the hopper H and support frame members 15 and 16 which extend longitudinally away from the door support portion of the frame and are welded to transverse angle member 14 and bracket members 17. The longitudinal members 15 and 16 in turn support another transverse member 18, the members 15, 16, 17 and 18 comprising the actuator support portion of the frame 10.

The power actuator comprises a cylinder 30 which operates by fluid pressure introduced through hoses 31 and 32 to control the position of a piston (not shown) within the cylinder, the piston being coupled with a piston rod 33 having an abutment 34 near its outer end which terminates in a spindle 35 carrying a nut 36 screwed onto its outer end and comprising a second abutment for the purpose hereinafter stated.

The other end of the cylinder 30 is supported in a clevis 37 which is carried by a transverse member 19 which also forms a part of the frame 10. The left end of the cylinder 30 is fixed to the cross member 18 by a U-bolt 38, whereby the cylinder 30 is made stationary with respect to the actuator support portion of the frame 10.

The turned down end 22 of the plate 21 which comprises the door 20 is connected to a rectangular bar 40 by a bracket 41 connected to the portion 22 of the door 20 by bolts 42. The bar 40 extends leftwardly from the door and moves with it longitudinally, and carries at its left end a transverse coupling plate 43 having a hole 44 extending through the plate and receiving the spindle portion 35 of the piston rod 33. The bar 40 passes through a rectangular guide member 45 having side walls 46 and 47 which in turn have elongaed slots 48 and 49 extending therethrough.

The bar 40 has a number of holes such as the holes 40*a*, 40*b* and 40*c* which pass all the way through the bar 40 and align with the slots 48 and 49 and with a hole 53 when the bar is in an appropriate position. For instance, when the slot 40*b* aligns with the slots 48 and 49 in the guide member 45, a pin 50 can be extended therethrough and held in place by a cotter 51. This assembly can be seen best in FIGS. 1, 2 and 5. With the pin 50 in place and passing through the slots 48 and 49, the longitudinal incremental movement of the bar 40 is limited to the length of the slots, FIG. 2, whereby the pin 40 and the bar 40 can only move through the distance X. This distance is slightly greater than the distance X' shown at the righthand end of FIG. 2, the difference being the distance d which is the depth of the channel C. Therefore, the distance X is equal to the distance X' plus the distance d. The distance X' is the maximum opening which is desirable for the purpose of distributing and spreading particulate material as shown by the arrows A at the righhand end of FIG. 2.

In addition, as can be seen best in FIGS. 1 and 4, the guide member 45 supports a spring urged latch member 52 opposite a hole 53 in the guide member 45. The latch member also includes a pin 54 carrying a washer 55 which compresses a coil spring 56 against an abutment 57 within the latch member 52. The spring 56 urges the pin 54 inwardly so as to enter a hole 40*c* in the bar 40. The pin has a cross member 58 at its outer end, and this cross member 58 can ride into a slot 59 in the side wall of the latch member 52, FIG. 1, whereupon the spring 56 inserts the pin 54 into the hole 40*c*, or into any of the other hole such as the holes 40*a* or 40*b* in the bar 40. The insertion of the pin 54 into one of these holes locks the door in the longitudinal position determined by the pin 54 and prevents accidental movement of the door, for instance if the controls should be accidentally operated to pressurize the cylinder 30.

The assembly is operated by applying fluid pressure selectively to the hoses 31 or 32 entering the cylinder 30 so as to drive the piston rod 33 longitudinally toward the hopper H or away from it to close or open the door 20 by sliding it longitudinally in the channels C as shown in FIG. 1. It will be noticed that the smaller diameter spindle portion 35 of the piston rod 33 passes through a hole 44 in the coupling plate 43. The fact that the abutments 34 and 36 are spaced apart along the spindle 35 of the piston rod provides lost motion so that the piston rod 33 can gather momentum before one or the other of the abutments 34 or 36 strikes the coupling plate 43 and delivers impact to it for the purpose of moving the bar 40 and the door 20 longitudinally of the frame 10, thereby to open or close the opening in the bottom of the hopper H. If it is desired to lock the frame in fully opened or fully closed position, the pin 54 as shown in FIG. 4 can be rotated so as to allow the cross member 58 to fall into the slot 59 of the latch member 52 and insert the pin 54 in one of the holes 40*a* or 40*c*, whereby the door is locked in position and cannot further be moved by the cylinder 30. On the other hand, the pin 54 can be pulled out against the pressure of the spring 56 and the cross member 58 can be rotated 90° from the slot 59 to the positon shown in FIG. 1, whereupon the latch is disengaged and will remain disengaged, thereby allowing the door to be moved.

If the closure assembly is to be used for spreading particulate matter, for instance salt upon a highway, the door can be fixed so that it can be opened only through a small increment X by inserting the pin 50, FIG. 5, through the slots 48 and 49 and through the hole 40*b*, whereupon as can be seen in FIG. 2 the door can be moved only through the small increment X which is sufficient to move it from a fully closed position to a somewhat opened position as shown in FIG. 2, the maximum possible opening being only sufficient to allow a very limited rate of flow of the material from the hopper H as represented by the arrows A in FIG. 2. The door can be fully closed with the pin 50 still extending through the slots 48 and 49 since the length of the slot X is equal to the length of the opening X′ plus the depth of the channel C as represented by the reference d.

This invention is not to be limited to the exact form shown in the drawings for obviously changes may be made within the scope of the following claim.

I clain:

1. A power actuated closure assembly for controlling the discharge of materials from an opening in the bottom of a hopper, comprising:

(a) a frame having a door support portion extending around the opening in said hopper and having a door receiving channel extending longitudinally of the frame, and the frame having a power actuator support portion fixed to the door support portion and extending longitudinally therefrom;

(b) a door comprising a plate reciprocably slidable longitudinally in said channel from a closed position wherein said door closes said opening, through intermediate positions, to an open position wherein the door substantially underlies the actuator support portion of the frame;

(c) power actuator means mounted on said actuator support portion of the frame and including a member longitudinally reciprocable toward and away from the door support portion of the frame; and including a longitudinal bar fixed to the door, guide means fixed to the frame and surrounding the bar, and means coupling the bar with said reciprocable member; and (d) manually controllable means operative between the bar and the guide means to arrest longitudinal reciprocation of the bar relative to the fixed guide means, said guide means having a wall surrounding the bar and the wall having an elongated slot therethrough extending longitudinally of the bar, said bar having a hole therein registering with the slot in some positions of the door; and said manually controllable means comprising a pin receivable in said hole and extending through the slot and limiting longitudinal movement of the door to the length of the slot.

2. In a closure assembly as claimed in claim 1, said actuator means comprising a cylinder fixed to the frame and having a pistoin rod comprising said reciprocable member; and said means coupling the bar to the rod comprising a lost-motion coupling permitting limited relative reciprocatory motion between the bar and the rod, whereby the piston rod can freely travel the length of said lost motion coupling to provide impact tending to help start the door moving in its supporting channel.

3. In a closure assembly as claimed in claim 2, said means coupling the bar to the rod comprising a transversely disposed plate fixed to the bar and having a hole through the plate, and the rod extending through the hole and having abutments fixed to the rod on both sides of the plate and spaced apart by a distance greater than the thickness of the plate.

4. In a closure assembly as claimed in claim 1, said bar being rectangular in cross-section and the guide means having a passage extending longitudinally therethrough which is rectangular in cross-section and closely fits around the bar.

5. In a closure assembly as claimed in claim 1, said guide means having a wall surrounding the bar and the wall having an opening therein, said bar having plural holes therein respectively registerable with the opening in the wall of the guide means in different positions of the door longitudinally of the frame; and said manually controllable means further comprising spring latch means carried on the wall of the guide means, the latch means including a bolt which is spring-urged to an operative position in which the bolt penetrates the opening and enters one of said holes, and the bolt having means for securing it in a withdrawn inoperative position.

6. In a closure assembly as claimed in claim 1, said door comprising a plate shaped to close said opening in the hopper the plate having one edge adjacent to the actuator support portion of the frame bent at right angles, and bracket means securing the bar to the plate at that edge.

7. In a closure assembly as claimed in claim 1, the door support portion of the frame comprising longitudinal channel members which extend longitudinally beyond the hopper in the direction of the actuator support portion of the frame, theactuator support portion of the frame including transverse members carried by the longitudinal members; and the actuator means comprising a cylinder supported on said transverse members and a piston rod comprising said reciprocable member.

8. In a closure assembly as claimed in claim 7, said guide means being fixed to one of said transverse members of the actuator support portion of the frame.

9. In a closure assembly as claimed in claim 7, a shaft disposed transversely across the frame and journaled in said longitudinal channel members; a pinion fixed to the shaft adjacent to each channel member; and a pair of racks disposed beneath the door and fixed thereto and respectively extending longitudinally of the door adjacent to each longitudinal channel member, and the racks having teeth meshed with the respective pinions.

* * * * *